US009907339B2

(12) United States Patent
Liu

(10) Patent No.: US 9,907,339 B2
(45) Date of Patent: Mar. 6, 2018

(54) ELECTRONIC CIGARETTE

(71) Applicant: KIMREE HI-TECH INC., Road Town, Tortola (VG)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 15/118,792

(22) PCT Filed: Feb. 12, 2014

(86) PCT No.: PCT/CN2014/072006

§ 371 (c)(1),
(2) Date: Aug. 12, 2016

(87) PCT Pub. No.: WO2015/120590

PCT Pub. Date: Aug. 20, 2015

(65) Prior Publication Data

US 2017/0049152 A1 Feb. 23, 2017

(51) Int. Cl.
*A24F 13/00* (2006.01)
*A24F 47/00* (2006.01)
(Continued)

(52) U.S. Cl.
CPC ..... *A24F 47/008* (2013.01); *B65D 15/02* (2013.01); *B65D 85/70* (2013.01); *H05B 1/0244* (2013.01);
(Continued)

(58) Field of Classification Search
CPC ..... A24F 47/008; H05B 3/44; H05B 3/04; H05B 2203/022; H05B 2203/014; H01M 2/1055
(Continued)

(56) References Cited

U.S. PATENT DOCUMENTS 9,380,811 B2 * 7/2016 Chung ..... A24F 47/008
2014/0144453 A1 * 5/2014 Capuano ..... A24F 47/008 131/329
(Continued)

FOREIGN PATENT DOCUMENTS

CN 103263083 A 8/2013
CN 203182013 U 9/2013
(Continued)

OTHER PUBLICATIONS

International Search Report (ISR) issued by the State Intellectual Property Office of the Peoples Republic of China on Nov. 18, 2014 for PCT/CN2014/072006, China.

*Primary Examiner* — Jean F Duverne
(74) *Attorney, Agent, or Firm* — Tim Tingkang Xia, Esq.; Locke Lord LLP

(57) ABSTRACT

An electronic cigarette comprises an electronic cigarette body which is provided with a smoking end, an oil reservoir, an atomization assembly, and a battery assembly. The oil reservoir is arranged at one end of the electronic cigarette body which is on an opposite side of the smoking end, and the atomization assembly is arranged in the oil reservoir, thus length of a whole electronic cigarette is shortened, and the electronic cigarette is portable. The oil reservoir is defined far away from the smoking end, so that a bad experience of sucking the tobacco tar by users can be effectively avoided. When smoking, the battery assembly close to the smoking end is held, and the oil reservoir is usually not supported by an external force, so that the oil reservoir outputs a uniform amount of the tobacco tar to the atomization assembly, and the stability of produced smoke is effectively ensured.

2 Claims, 4 Drawing Sheets

(51) Int. Cl.

| | |
|---|---|
| ***B65D 8/00*** | (2006.01) |
| ***B65D 85/00*** | (2006.01) |
| ***H05B 1/02*** | (2006.01) |
| ***H05B 3/04*** | (2006.01) |
| ***H05B 3/44*** | (2006.01) |

(52) U.S. Cl.
CPC ..... *H05B 3/04* (2013.01); *H05B 3/44* (2013.01); *H05B 2203/014* (2013.01); *H05B 2203/021* (2013.01); *H05B 2203/022* (2013.01)

(58) Field of Classification Search
USPC ..... 131/329
See application file for complete search history.

(56) References Cited

U.S. PATENT DOCUMENTS

| | | | | |
|---|---|---|---|---|
| 2014/0261492 | A1* | 9/2014 | Kane | A24F 47/008 131/328 |
| 2014/0299137 | A1* | 10/2014 | Kieckbusch | A24F 47/008 131/328 |
| 2015/0164141 | A1* | 6/2015 | Newton | H01M 2/1055 131/329 |
| 2017/0215482 | A1* | 8/2017 | Levitz | A24F 47/008 439/178 |

FOREIGN PATENT DOCUMENTS

| | | | |
|---|---|---|---|
| CN | 203327954 | U | 12/2013 |
| CN | 103929990 | A | 7/2014 |
| WO | 2013050934 | A1 | 4/2013 |

* cited by examiner

ELECTRONIC CIGARETTE

TECHNICAL FIELD

The present application relates to the technical field of cigarette substitutes, and more particularly, relates to an electronic cigarette.

BACKGROUND

An electronic cigarette in the prior art is shown in FIG. 1, referring to FIG. 1, the electronic cigarette in the prior art comprises an atomization assembly 110 and a battery assembly 120 which are connected to each other mutually, a smoking end 100 is defined at one end of the atomization assembly 110 which is on an opposite side of the battery assembly 120. Meanwhile, the atomization assembly 110 comprises an oil storage cotton 111 which is used to store tobacco tar; an oil transferring cotton 112 and a heating coil assembly 113 are defined in the oil storage cotton 111. A smoking passage is defined inside the electronic cigarette to ensure smoke which is atomized by the heating coil 113 can be inhaled by users through the smoking passage.

In the electronic cigarette which is shown by FIG. 1, a position of the oil storage cotton 111 is close to the smoking end 100, and the oil storage cotton 111 is defined inside the smoking passage, which means that, the tobacco tar which is stored in the oil storage cotton 111 is easy to leak to the smoking passage, and the smoke that flows through the smoking passage is easy to be condensed as the tobacco tar absorbs a heat energy of the smoke, thus tobacco tar without an atomization or with a condensation will be inhaled by the users; besides, when smoking, a mouth of a user holds on an outside of an oil storage region, different volumes of the tobacco tar are transferred to the heating coil assembly 113 as the oil storage cotton 111 is held by different holding force of the mouth, leading to an unstable amount of the smoke, and an excessive amount of the tobacco tar makes an electrical coil in an atomization area of the heating coil assembly 113 be submerged by the tobacco tar and lose an ability to atomize the tobacco tar to generate the smoke, and it is easy to cause a leakage of the tobacco tar, leading to an inhalation of the tobacco tar by the users. Moreover, the atomization assembly 110 in the prior is defined between the battery assembly 120 and the suction nozzle 100, thus, a whole length of the electronic cigarette is long, and is not favorable for carrying.

BRIEF SUMMARY

The object of the present application is to provide an electronic cigarette which avoids users to inhale the tobacco tar, has a short length, and is portable, aiming at the drawbacks in the prior art that the whole length of the electronic cigarette is too long, the electronic cigarette is inconvenient to carry, and the users are easy to inhale the tobacco tar.

A technical proposal adopted by the present invention to solve technical problems is to provide an electronic cigarette, comprises:

An electronic cigarette body;

The electronic cigarette body is provided with a smoking end, an oil reservoir for accommodating tobacco tar, an atomization assembly for atomizing the tobacco tar, and a battery assembly for supplying an electrical power to the atomization assembly;

The oil reservoir is arranged at one end of the electronic cigarette body which is on an opposite side of the smoking end; and The atomization assembly is arranged inside the oil reservoir.

In the electronic cigarette according of the present invention, the battery assembly is defined between the smoking end and the oil reservoir, the oil reservoir is detachably connected to the battery assembly.

In the electronic cigarette according of the present invention, the atomization assembly is detachably connected to an inside of the oil reservoir.

In the electronic cigarette according of the present invention, the battery assembly comprises:

A battery sleeve;

A battery which is accommodated inside the battery sleeve;

A first thread sleeve which is defined at an end of the battery sleeve which is close to the oil reservoir and is used for detachably connecting to the oil reservoir (2).

In the electronic cigarette according of the present invention, the atomization assembly comprises:

A heating coil assembly which is used for atomizing the tobacco tar;

An oil transferring device which is used for transferring the tobacco tar in the oil reservoir to the heating coil assembly.

In the electronic cigarette according of the present invention, the atomization assembly further comprises:

An atomization support;

An atomization electrode which is fixedly defined inside the atomization support and is electrically connected to the heating coil assembly;

An insulating ring which is defined between the atomization support and the atomization electrode;

An atomization sleeve which is defined on the atomization support, the oil transferring device is defined inside the atomization sleeve.

In the electronic cigarette according of the present invention, the oil reservoir comprises:

A body portion;

A second thread sleeve which is defined at an end of the body portion which is close to the battery assembly and is used for detachably connecting to the first thread sleeve;

A baffle is defined inside the body portion along a radial direction of the body portion, the baffle divides a hollow inner space of the body portion into an oil storage chamber and an accommodating chamber which is used for accommodating the atomization assembly, and the oil storage chamber is insulated with the accommodating chamber;

An inserting hole which is used for inserting the oil transferring device into the oil storage chamber is defined at the baffle.

In the electronic cigarette according of the present invention, a sealing ring which is defined with a through hole is defined inside the inserting hole.

In the electronic cigarette according of the present invention, a film which can be pierced and is used for sealing the oil transferring device is defined inside the through hole of the sealing ring.

In the electronic cigarette according of the present invention, the oil reservoir comprises:

A body portion;

A protrude portion which is defined at an end surface of the body portion which is close to the battery assembly and is formed with a decreasing diameter of the body portion along an axial direction of the body portion, a via hole which is used for inserting the oil transferring device into the body portion which is a hollow structure is defined in the protrude portion;

In the electronic cigarette according of the present invention, the atomization support is fixedly abutted against the protrude portion, and a second thread sleeve which is used for detachably connecting to the first thread sleeve is defined at the atomization support.

In the electronic cigarette according of the present invention, a filling hole which is used for filling the tobacco tar is defined at an end surface of the body portion which is close to the battery assembly, a hole plug is detachably defined at the filling hole.

In the electronic cigarette according of the present invention, a first air inlet is defined on a sidewall of the body portion which faces to the accommodating chamber, a smoke passage which is used for communicating the first air inlet with the smoking end is defined inside the battery assembly.

In the electronic cigarette according of the present invention, a second air inlet is defined at a sidewall of the battery sleeve which is close to the oil reservoir, a smoke passage which is used for communicating the second air inlet with the smoking end is defined inside the battery assembly.

In the electronic cigarette according of the present invention, the smoking end is defined outside an end of the battery assembly, or the smoking end is placed in a middle part of the battery assembly, or the smoking end is arranged at a position of the battery assembly which is on an opposite side of the oil reservoir.

In the electronic cigarette according of the present invention, the atomization assembly is coaxially defined with the battery assembly.

In the electronic cigarette according of the present invention, the oil reservoir is a transparent container.

In the electronic cigarette according of the present invention, a control module which is used for controlling the battery assembly to supply the electrical power to the atomization assembly is defined at one side of the battery assembly which is close to the smoking end.

With application of the electronic cigarette, the following advantages can be achieved: by defining the oil reservoir at one end of the electronic cigarette body which is on an opposite side of the smoking end, and the atomization assembly is arranged in the oil reservoir, compared with the prior art, the length of the whole electronic cigarette is shortened, and it is convenient for the user to carry the electronic cigarette; the oil reservoir for accommodating the tobacco tar is on an opposite side of the smoking end, so that when an user uses the electronic cigarette, the bad experience of sucking the tobacco tar by the users can be effectively avoided; when the user smokes, in general, the battery assembly which is close to the smoking end is held, and the oil reservoir is usually not supported by the external force, so that the oil reservoir outputs a uniform amount of the tobacco tar to the atomization assembly, and the stability of produced smoke is effectively ensured.

BRIEF DESCRIPTION OF THE DRAWINGS

The present application will be further described with reference to the accompanying drawings and embodiments in the following.

DETAILED DESCRIPTION OF THE PREFERRED EMBODIMENTS

The example embodiments of the present application will be further described with referencing to the accompanying drawings, to have a clear understanding of the technical features, purposes and effects of the present invention. Obviously, the following example embodiments are only parts of the embodiments of the present application.

Figure 1:
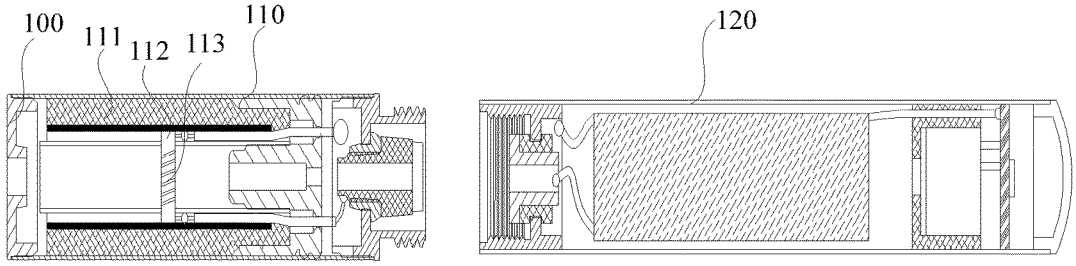
FIG. 1 is a view of an electronic cigarette provided by the prior art.
Figure 2:
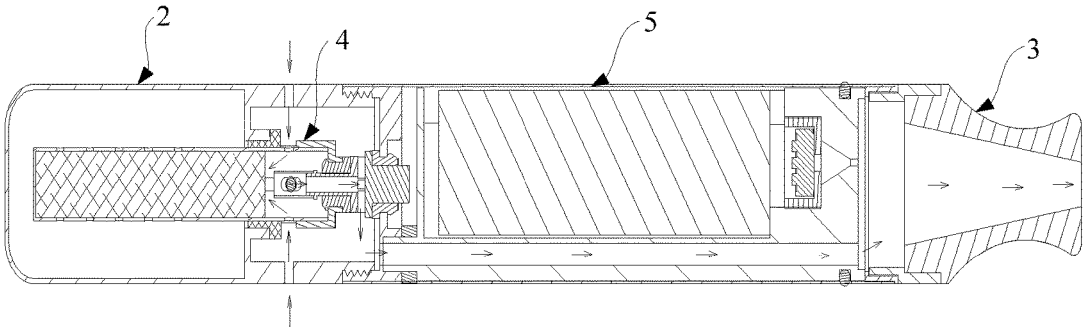
FIG. 2 is a cutaway view of a whole structure of the electronic cigarette provided by a first embodiment of the present application.

Refer to FIG. 2, an electronic cigarette which is provided by the first embodiment, the electronic cigarette comprises:

An electronic cigarette body, and the electronic cigarette body is provided with a smoking end 3, users can smoke through the smoking end 3.

The electronic cigarette body further defines an oil reservoir 2 for accommodating tobacco tar, which mean that, the tobacco tar which can be atomized is stored inside the oil reservoir 2.

An atomization assembly 4 for atomizing the tobacco tar, which means that, the tobacco tar in the oil reservoir 2 can be atomized by the atomization assembly 4.

A smoking passage (not labeled in figures) which is used for slowing an atomized tobacco tar is defined inside the electronic cigarette body, to ensure users to inhale the atomized tobacco tar which flows through the smoking passage by the smoking end. The electronic cigarette body further comprises a battery assembly 5 which is used for providing an electrical power to the atomization assembly 4.

As shown in FIG. 2, the oil reservoir 2 is defined at one end of the electronic cigarette which is on an opposite side of the smoking end 3, advantages of this approach is that, as the oil reservoir 2 is defined at the opposite aide of the smoking end 3, the smoke passage which is defined inside the electronic cigarette body does not pass through the oil reservoir, a non-atomized tobacco tar in the oil reservoir will not leak to the smoke passage, then users cannot inhale the non-atomized tobacco tar, thus users can be effectively prevented from sucking the non-atomized cigarette oil which caused by a leakage of the tobacco tar, and users' experience is improved. The atomization assembly 4 is defined inside one end of the oil reservoir 2 which is on an opposite side of the smoking end 2, which means that, the atomization assembly 4 is far from a mouth of a user, Thus, heat energy which is generated the atomization assembly 4 does not scalded the mouth of the user, and a safety of using is effectively improved, and during smoking, the users hold the battery assembly 5 to smoke rather than hold the atomization assembly 4 which generates heat, so as to ensure hands of the users do not to be scalded during using the electronic cigarette in the present embodiment, thus to improve using experience during smoking of the users. Further, the atomization assembly 4 is detachably connected to the oil reservoir 2, then it is convenient to pull out the atomization assembly 4, and to replace the oil reservoir 2 or fill the tobacco tar into the oil reservoir 2.

The atomization assembly 4 is arranged in the oil reservoir 2, thus the whole length of the electronic cigarette is composed of the oil reservoir 2, the battery assembly 5 and the suction nozzle 3, compared with the atomization assembly 4 in the prior art that, the atomization assembly 4 is separately defined between the battery assembly and the suction nozzle, the whole length of the electronic cigarette is shorten, and the electronic cigarette is portable.

The battery assembly 5 is defined between the smoking end 3 and the oil reservoir 2, when the users are using the electronic cigarette to smoke, they will hold a middle or upper position of the electronic cigarette body which is close to the smoking end 3, which means that they will hold at a position that the battery assembly 5 is located, as the oil reservoir 2 is defined at the end which is on an opposite side of the suction nozzle 3, the oil reservoir 2 is not held by an external force, then the amount of the tobacco tar which is transferred from the oil reservoir 2 to the atomization assembly 4 is uniform, and a stability of the smoke which is generated can be effectively ensured.

In the present embodiment, the smoking end 3 is defined outside an end of the battery assembly 5, or the smoking end 3 is placed in a middle part of the battery assembly 5, or the smoking end 3 is arranged at a position of the battery assembly 5 which is on an opposite side of the atomization assembly 4, and the whole smoking passage is relatively straight, so as to effectively reduce the phenomenon of an oil accumulation. In the present invention, a position of the smoking end 3 is not limited, as well as the smoking end 3 is defined on an opposite side of the oil reservoir 2.

Specifically, the atomization assembly 4 and the battery assembly 5 is defined coaxially to simulate a real cigarette and to conform to the user's habits.

Certainly, a specific way of defining is not be qualified in the present embodiment, for example, the smoking end 3, the battery assembly 5 and the oil reservoir 2 can be staggered defining, to enable an overall appearance of the electronic cigarette is a specific shape, and the specific shape of the electronic cigarette can be any shapes.

The atomization assembly 4 and the battery assembly 5 can be non-coaxially defined, for instance, the oil reservoir 2 and the battery assembly 5 are defined parallel, and it is not limited here.

The oil reservoir 2 is detachably connected to the battery assembly 5, and/or the battery assembly 5 is detachably connected to the smoking end 3, and/or the atomization assembly 4 is detachably connected inside the oil reservoir 2. The detachable connection mode can be a thread connection or a clamping connection, etc., a specific connection mode is not limited, as long as the oil reservoir 2 is detachably connected to the battery assembly 5, and/or the battery assembly 5 is detachably connected to the smoking end 3, and/or the atomization assembly 4 is detachably connected inside the oil reservoir 2.

The advantage of adopting the detachable connection mode is that, convenient user to replace the suction nozzle 3 at any time or to remove the oil reservoir 2 at any time.

Figure 4:
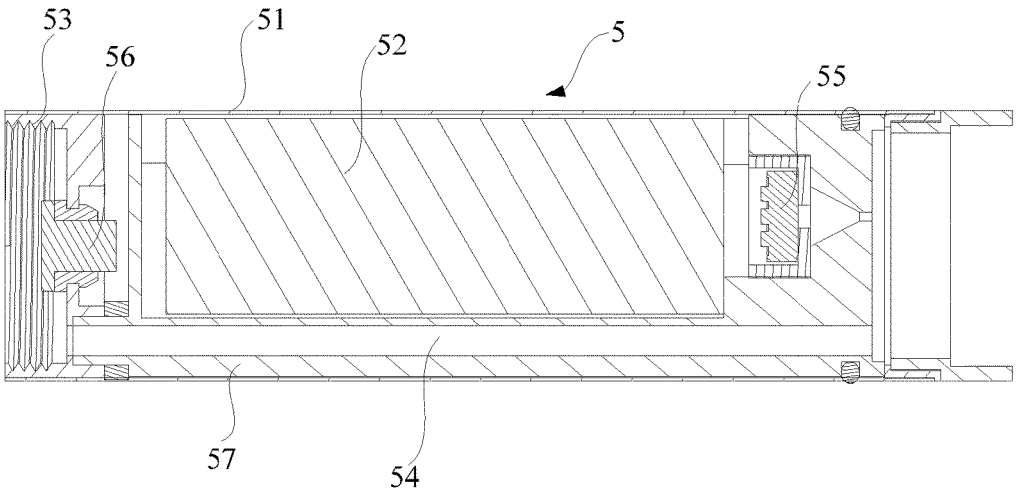
FIG. 4 is a structure diagram of a battery assembly provided by a first embodiment of the present application.

Refer to FIG. 4, the battery assembly 5 is used for providing an electrical power to the atomization assembly 4, to enable the atomization assembly 4 to generated the smoke to be inhaled by the users. The battery assembly comprises a battery sleeve 51, a battery 52, a first thread sleeve 53, an installing support 57 and a first electrode configuration 56.

The battery sleeve 51 is generally a hollow cylindrical structure, which has a same outer diameter with the oil reservoir 2, when the battery sleeve 51 is connected to the oil reservoir 2, both of them forms a flat surface, to enhance an overall effect of the electronic cigarette. In the present embodiment, a thread connection between the oil reservoir 2 and the battery assembly 5 is described as an example, which means that, the oil reservoir 2 is threaded connected to the battery assembly 5, thus a first thread sleeve 53 which is used for being detachably connected to the oil reservoir 2 is defined one end of the battery sleeve 51 which is close to the oil reservoir 2, if other detachable connection modes are adopted, then other connection configuration can be defined at one end of the battery sleeve 51 which is close to the oil reservoir 2, for instance, a buckling elastic piece which has a flexibility in the bucking connection, in the present embodiment, the thread sleeve is taken as an example, but it is not limited to the thread sleeve. Specifically, the first thread sleeve 53 is an internal thread.

The battery 52 is used for providing an electrical power to the atomization assembly 4, and is fixedly defined inside the battery sleeve 51. The installing support 57 is fixedly installed on an inner wall of the battery sleeve 51 along an axial direction of the battery sleeve 51, specifically, the battery 52 is fixedly installed on the installing support 57, the smoking passage 54 is defined along an axial direction of the battery sleeve 51, the smoking passage 54 and the battery are defined in parallel and along an axial direction of the battery sleeve 51, and they are both defined inside the battery sleeve 51 and are insulated with each other.

a control module 55 which is used for controlling the battery assembly 5 to supply an electrical power to the atomization assembly 4 is defined at one side of the battery assembly 5 which is close to the smoking end 3, the control module 55 is provided with an airflow sensor (not labeled in figures). When users inhale the electronic cigarette, the airflow sensor can detect a change of the airflow in the electronic cigarette, to control the battery assembly 5 to electrically connect with the atomization assembly 4, so as to motivate the atomization assembly 4 to work.

The first electrode configuration 56 is installed at one end of the battery sleeve 51 which is close to the oil reservoir 2, and is electrically connected to two electrodes of the battery 52. In the present embodiment, the first electrode configuration 56 is a common electric connection structure in the prior art, and details are not reiterated here.

Figure 3:
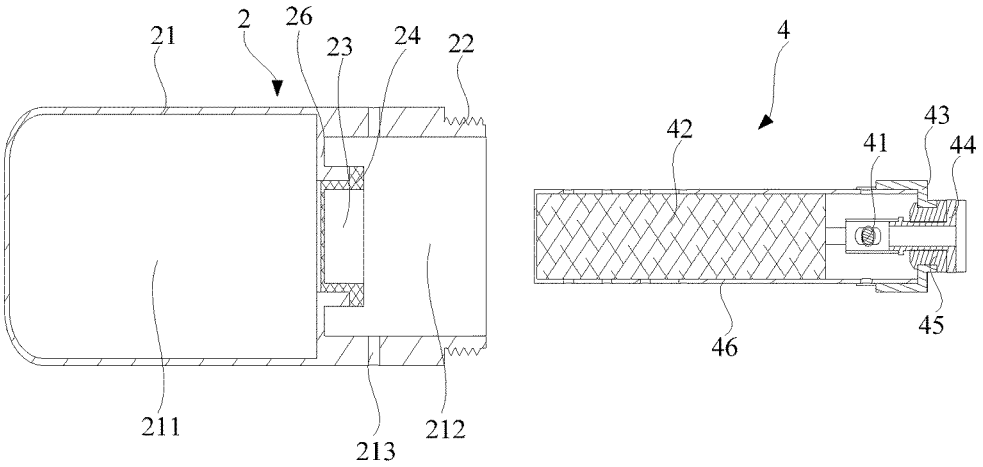
FIG. 3 is a structure of an oil reservoir and an atomization assembly provided by a first embodiment of the present application.

Refer to FIG. 3, the atomization assembly 4 comprises a heating coil assembly 41, an oil transferring device 42, an atomization support 43, an atomization electrode 44, an insulating ring 45 and an atomization sleeve 46.

The atomization support 43 is a hollow cylindrical structure, with opening at both ends. The atomization electrode 44 is defined inside the atomization support 43, and the atomization electrode 44 is connected to the heating coil assembly 41, the insulating ring 45 is defined between the atomization support 43 from the atomization electrode 44 to electrically insulated the atomization support 43 and the atomization electrode 44. When the oil reservoir 2 is connected to the battery assembly 5, the atomization electrode 44 is connected to the first electrode configuration 56, to realize the battery assembly 5 to supply electrical power to the atomization assembly 4. In the present embodiment, the atomization electrode 44 is a common electrode configuration in the prior art.

The atomization sleeve 46 is general a hollow cylindrical structure, and one end of the atomization sleeve 46 is fixedly inserted in one side of the atomization electrode 43 which is on an opposite aide of the battery assembly. The oil transferring device 42 is fixedly installed inside the atomization sleeve 46, and one end of the oil transferring device 42 is inserted inside the oil reservoir 2 to absorb the tobacco tar which is stored in the oil reservoir 2, and then transfer the tobacco tar to the heating coil assembly 41 to atomize; the heating coil assembly 41 is used to atomize the tobacco tar which is transferred from the oil reservoir 2 by the oil transferring device 42, and the heating coil assembly 41 is fixedly installed between the oil transferring device 42 and the atomization support 43. Specifically, the oil transferring device 42 can be used as an oil transferring cotton, an oil transferring fiber and other materials with an adsorption function, and the material is not limited here.

As shown in FIG. 3, the heating coil assembly 41 is defined between the oil reservoir 42 and the atomization support 43, the smoke which is generated by the heating coil assembly 41 during working does not flow through the oil reservoir 2, thus the smoke which is generated by the atomization assembly 4 during working can flow to the smoking end 3 without flowing through the oil reservoir 2, thus the smoke does not condensate under an effect of the oil reservoir 2, then a passage which used for air flowing in the electronic cigarette is not blocked. In the present embodiment, a shape of the oil transferring device 42 is not limited, it can be square and so on.

As shown in FIG. 3, the oil reservoir 2 is generally a hollow cylinder with an opening end which is close to the battery assembly 5. The oil reservoir 2 comprises a body portion 21, a baffle 26, a sealing ring 24 and a film 23 which can be pierced.

The body portion 21 is a hollow cylinder with an opening at one end, the body portion 21 is roughly a U type, and a second thread sleeve 22 is defined at a sidewall of an end of the body portion 21 which is close to the battery assembly 5 and is used to be detachably connected to the battery assembly 5. Specifically, in the present embodiment, the second thread sleeve 22 is an external thread.

The baffle 26 is a ring which is defined inside the body portion 21 along a radial direction of the body portion 21, thus, the baffle 26 divides an inner space of the body portion 21 into an oil storage chamber 211 and an accommodating chamber 212, wherein, the accommodating chamber 212 is defined at one end which is close to the battery assembly 5, and is used to accommodate the atomization assembly 4, and the oil storage chamber 211 is insulated with the accommodating chamber 212; a first air inlet 213 is defined on a sidewall of the body portion 21 which faces to the accommodating chamber 212, the first air inlet 213 is communicated with outer air to allow the outer air to flow into the electronic cigarette; and the first air inlet 213 is communicated with the smoking passage 54 in the electronic cigarette to enable air which is flow into the electronic cigarette through the first air inlet 213 to bring the smoke which is atomized by the heating coil assembly 41 to flow through the smoking passage 54, then flows to the smoking end 3 to be provided by the users (a specific flow direction of the air flows in the electronic cigarette is shown by the direction of arrows in FIG. 2); specifically, shapes and amounts of the first air inlet 213 are not limited here.

The baffle 26 is made of a hard material to ensure the oil storage chamber 211 is insulated and sealed with the accommodating chamber 212. An inserting hole (not labeled in figures) which is used for inserting the oil transferring device 42 into the oil storage chamber 211 is defined at the baffle 26, the inserting hole is a through hole which is defined at the baffle 26 along an axial direction of the baffle 26, a sealing ring 24 which is defined with a through hole is defined inside the inserting hole, a film 23 which can be pierced and is used to seal the oil transferring device 42 is defined inside the through hole of the sealing ring 24; thus, when the oil transferring device 42 is inserted into the oil storage chamber 211 through the inserting hole, the oil transferring device 42 breaks the film 23 which can be pierced firstly, then is sealed inside the through hole of the sealing ring 24 to realize a sealing tightness of the oil transferring device 42.

In order to allow the users to know a remaining amount of the tobacco tar inside the oil reservoir 2, the oil reservoir 2 is designed as a transparent container to ensure the users to know a remaining amount of the tobacco tar at any time, making it convenient for the users to replace oil reservoir 2 in time or to add the tobacco tar to oil reservoir in time.

Preferably, the oil reservoir 2 can also be a glass bottle. As a glass material has more stable properties to avoid the occurrence of chemical reactions and effects of tobacco tar flavor.

Preferably, a scale is arranged on an outer peripheral wall of the oil reservoir 2 which is made of glass materials, so that the user can estimate a duration that residue tobacco tar amount is available for inhaling, and it is convenient for users to use.

Further, a protective sleeve (not shown in the figure) is provided outside the oil reservoir 2, in order to avoid the situation that the oil reservoir 2 which is made of glass materials is broken due to falling.

Preferably, the protective sleeve is provided with a smoke observation window (not shown in figures), to enable the users to observe a remaining volume of the tobacco tar in the oil reservoir 2 through the observation window.

When assembly the electronic cigarette, firstly, the atomization assembly 4, the battery assembly 5 and the oil reservoir 2 are assembled respectively, then the atomization assembly 4 is fixedly installed inside the oil reservoir 2, finally, the oil reservoir 2 which is provided with the atomizing assembly 4, the battery assembly 5 and the suction nozzle 3 are connected in turn, and after completing the assembly, the atomization electrode 44 of the atomization assembly 4 is abutted against the first electrode configuration 56 of the battery assembly 5 and form a fix connection.

In general, with application of the electronic cigarette which is provided by the above embodiment, following advantages can be achieved:

(1) As the oil reservoir 2 is defined at one end of the electronic cigarette body which is on the opposite aide of the smoking end 3, the oil reservoir 2 which is used to store the tobacco tar is far from the smoking end 3, when the users are using the electronic cigarette, a bad experience of sucking the non-atomized cigarette oil can be effectively avoided.

(2) As the atomization assembly 4 is defined inside the oil reservoir 2, compared with the prior art, the whole length of the electronic cigarette is shorten, and the electronic cigarette is portable.

(3) As the oil reservoir 2 is defined at the end which is on the opposite aide of the smoking end 3, the oil reservoir 2 is usually not held by an external force, so that the oil reservoir 2 outputs a uniform amount of the tobacco tar to the atomization assembly 4, and the stability of produced smoke is effectively ensured.

(4) As the heating coil assembly 41 is accommodated in the accommodating chamber 212, the smoke which is generated by the heating coil assembly 41 during working does not flow through the oil reservoir 2, thus the smoke which is generated by the atomization assembly 4 during working can flow to the smoking end 3 without flowing through the oil reservoir 2, thus the smoke does not condensate under an effect of the oil reservoir 2, then a passage which used for air flowing in the electronic cigarette is not blocked.

(5) By defining the battery assembly 5 between the oil reservoir 2 and the suction nozzle 3, and the atomization assembly 4 is defined inside the oil reservoir 2, thus the atomization assembly 4 is far away from the smoking end 3, when smoking, the atomization assembly 4 is far away from a mouth of a user, thus, heat energy which is generated the atomization assembly 4 does not scalded the user, and a safety of using is effectively improved. Meanwhile, during smoking, users hold the battery assembly 5 to smoke rather than hold the atomization assembly 4 which generates heat, so as to ensure hands of the users do not to be scalded during using the electronic cigarette, thus to effectively simulate a temperature of a real cigarette, and to improve using experience during smoking of the users.

(6) The smoke passage which is defined inside the electronic cigarette body does not pass through the oil reservoir 2, so as to prevent the tobacco tar leaking to the smoke passage, and effectively avoid a leakage phenomenon of the electronic cigarette.

(7) The atomization assembly 4 of the electronic cigarette is detachably defined inside the oil reservoir 2, when the atomization assembly 4 is broken, it is convenient for users to replace the atomization assembly 4; and it is convenient for users to add the tobacco tar or replace the oil reservoir 2.

(8) the smoking end 3 is detachably connected to the battery assembly 5, then it is convenient for users to remove the smoking end 3 to clean.

Figure 5:
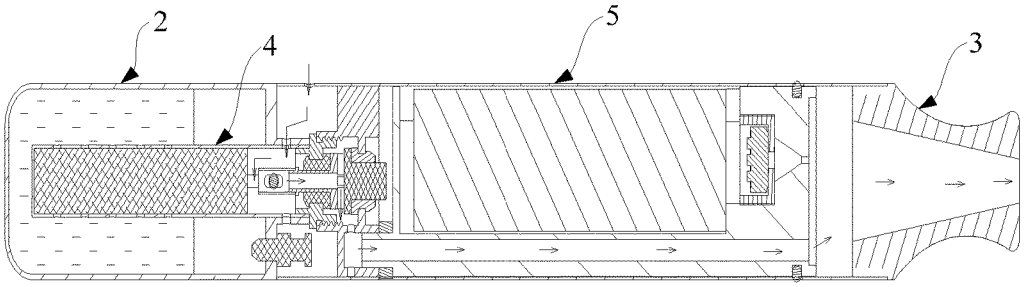
FIG. 5 is a cutaway view of a whole structure of the electronic cigarette provided by a second embodiment of the present application.
Figure 6:
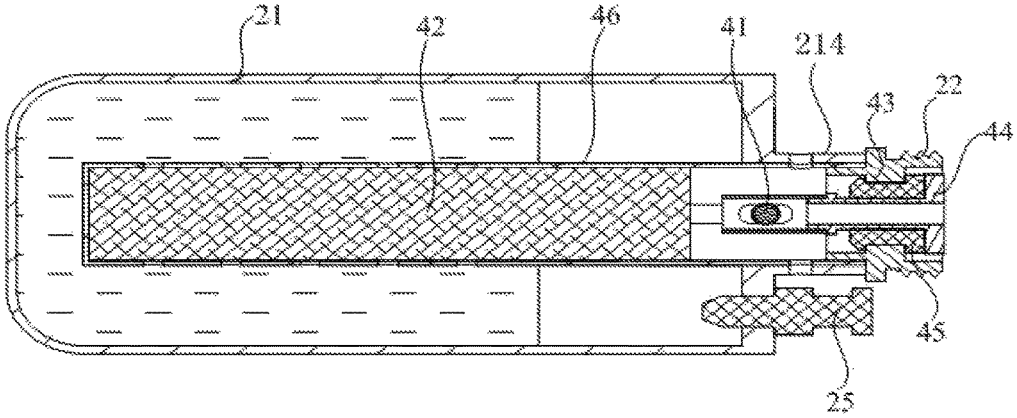
FIG. 6 is a structure of an oil reservoir and an atomization assembly provided by a second embodiment of the present application.
Figure 7:
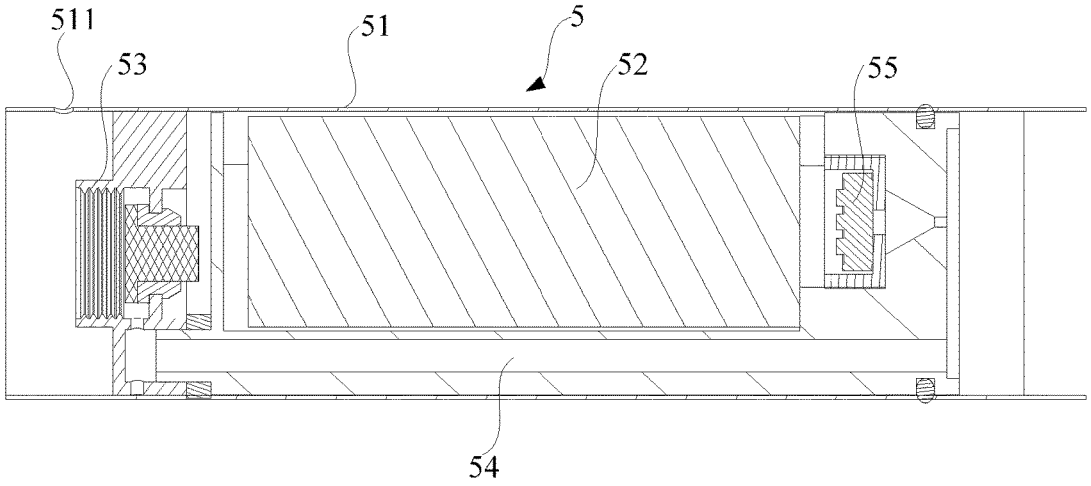
FIG. 7 is a structure diagram of a battery assembly provided by a second embodiment of the present application.

As shown in FIG. 5, FIG. 6 and FIG. 7, a second embodiment of the present invention provides an electronic cigarette, structures of an oil reservoir 2, an atomizing assembly 4 and a battery assembly 5 are different from the first embodiment. Specifically, the oil reservoir 2 in the present embodiment comprises a body portion 21 and a protrude portion 214, the body portion is a hollow bottle shaped structure in general, which means that, the protrude portion 214 which is defined at an end surface of the body portion 21 which is close to the battery assembly 5 and is formed by a decreasing diameter of the body portion 21 along an axial direction of the body portion 21. A via hole which is used for inserting the oil transferring device 42 into the body portion 21 which is a hollow structure is defined in the protrude portion 214 along an axial direction of the protrude portion 214. Preferably, a filling hole (not shown in figures) which is used for adding the tobacco tar is defined at an end surface of the body portion 21 which is close to the battery assembly 5, the filing hole id provided with a hole plug 25 which is buckled connected to the filling hole, when the oil reservoir 2 is needed to be added tobacco tar, only the hole plug 25 on the filling hole is pulled out, the tobacco tar is added to the oil reservoir 2 through the filling hole. Thus to avoid that the tobacco tar is only can be added to oil reservoir 2 when the oil reservoir 2 is removed from the atomizing assembly 4, if the tobacco tar is added too many times, it is possible to cause a problem that the atomization assembly 4 and the oil reservoir 2 is not sealed tightly, and the second embodiment prolong a service life of the electronic cigarette. Shapes and amounts of the filling hole are not limited, as long as the filling hole is defined at an end surface of the body portion 21 which is close to the battery assembly 5; amounts of the hole plug 25 are equaled to those of the filling holes, and are defined corresponding to the filling hole.

Differences of the atomization assembly 4 with that in the first embodiment are that, a part of the atomization support 43 is defined outside the oil reservoir 2, the atomization support 43 is abutted against the protrude portion 214, and a second thread sleeve 22 which is used to detachably connect to a first thread sleeve 53 is defined at an outer sidewall of the atomization support 43 which is located at the oil reservoir 2. The present embodiment realize a detachable connection between the oil reservoir 2 and the battery assembly 5 by a detachable connection between the atomization assembly 4 and the battery assembly 5.

Differences of the battery assembly 4 with that in the first embodiment are that, a second air inlet 511 is defined at a sidewall of the battery sleeve 51 which is close to the oil reservoir 2, a smoke passage 54 which is used for communicating the second air inlet 511 with the smoking end 3 is defined inside the battery assembly 5, the second air inlet 511 is communicated with outer air to allow the outer sir to flow into the electronic cigarette; and the second air inlet 511 is communicated with the smoking passage 54 in the electronic cigarette to enable air which is flow into the electronic cigarette through the second air inlet 511 to bring the smoke which is atomized by the heating coil assembly 41 to flow through the smoking passage 54, then flows to the smoking end 3 to be provided by the users (a specific flow direction of the air flows in the electronic cigarette is shown by the direction of arrows in FIG. 2); specifically, shapes and amounts of the second air inlet 511 are not limited here.

With an application of the electronic cigarette which is provided in the second embodiment, the advantages of the electronic cigarette of the first embodiment can be achieved as well.

In the third embodiment of the present embodiment, differences between the first embodiment and the second embodiment are that, the atomization assembly 4 is not detachably connected to the oil reservoir 2 in the present embodiment, for instance, the atomization assembly 4 is connected with the oil reservoir 2 by an interference fitting and other fixing connection modes, specific fixing connection modes are prior arts, and details are not repeated here.

Above illustrated embodiments of the present invention with attached figures, which are only some preferable embodiments of the present invention, cannot be utilized to limit the claim scope of the present invention. The specific implementation of the above is only schematic, rather than restrictive. It should be understood that, in the inspiration of the present application, those skilled in the art who appreciate and realize all or part of the process in above embodiments may make many modifications or alternatives, without going beyond the purpose and the scope the claims intend to protect of the present application. All these belong to the protection of the present application.

What is claimed is:

1. An electronic cigarette, wherein, comprises:

an electronic cigarette body;

the electronic cigarette body is provided with a smoking end (3), an oil reservoir (2) for accommodating tobacco tar, an atomization assembly (4) for atomizing the tobacco tar, and a battery assembly (5) for supplying an electrical power to the atomization assembly (4);

the oil reservoir (2) is arranged at one end of the electronic cigarette body which is on an opposite side of the smoking end (3); and the atomization assembly (4) is arranged inside the oil reservoir (2);

a control module (55) which is used for controlling the battery assembly (5) to supply the electrical power to the atomization assembly (4) is defined at one side of the battery assembly (5) which is close to the smoking end (3);

the battery assembly (5) is defined between the smoking end (3) and the oil reservoir (2), the oil reservoir (2) is detachably connected to the battery assembly (5);

the atomization assembly (4) is detachably connected to an inside of the oil reservoir (2);

the battery assembly (5) comprises:

a battery sleeve (51);

a battery (52) which is accommodated inside the battery sleeve (51);

a first thread sleeve (53) which is defined at an end of the battery sleeve (51) which is close to the oil reservoir (2) and is used for detachably connecting to the oil reservoir (2);

the atomization assembly (4) further comprises:

an atomization support (43);

an atomization electrode (44) which is fixedly defined inside the atomization support (43) and is electrically connected to a heating coil assembly (41);

an insulating ring (45) which is defined between the atomization support (43) and the atomization electrode (44);

an atomization sleeve (46) which is defined on the atomization support (43), an oil transferring device (42) is defined inside the atomization sleeve (46);

the oil reservoir (2) comprises:

a body portion (21);

a second thread sleeve (22) which is defined at an end of the body portion (21) which is close to the battery assembly (5) and is used for detachably connecting to the first thread sleeve (53);

a baffle (26) is defined inside the body portion (21) along a radial direction of the body portion (21), the baffle (26) divides a hollow inner space of the body portion (21) into an oil storage chamber (211) and an accommodating chamber (212) which is used for accommodating the atomization assembly (4), and the oil storage chamber (211) is insulated with the accommodating chamber (212);

an inserting hole which is used for inserting the oil transferring device (42) into the oil storage chamber (211) is defined at the baffle (26);

a sealing ring (24) which is defined with a through hole is defined inside the inserting hole;

a first air inlet (213) is defined on a sidewall of the body portion (21) which faces to the accommodating chamber (212), a smoke passage (54) which is used for communicating the first air inlet (213) with the smoking end (3) is defined inside the battery assembly (5);

a film (23) which can be pierced and is used for sealing the oil transferring device (42) is defined inside the through hole of the sealing ring (24);

the smoking end (3) is defined outside an end of the battery assembly (5), or the smoking end (3) is placed in a middle part of the battery assembly (5), or the smoking end (3) is arranged at a position of the battery assembly (5) which is on an opposite side of the oil reservoir (2);

the atomization assembly (4) is coaxially defined with the battery assembly (5);

the oil reservoir (2) is a transparent container.

2. An electronic cigarette, wherein, comprises:

an electronic cigarette body;

the electronic cigarette body is provided with a smoking end (3), an oil reservoir (2) for accommodating tobacco tar, an atomization assembly (4) for atomizing the tobacco tar, and a battery assembly (5) for supplying an electrical power to the atomization assembly (4);

the oil reservoir (2) is arranged at one end of the electronic cigarette body which is on an opposite side of the smoking end (3); and the atomization assembly (4) is arranged inside the oil reservoir (2);

a control module (55) which is used for controlling the battery assembly (5) to supply the electrical power to the atomization assembly (4) is defined at one side of the battery assembly (5) which is close to the smoking end (3);

the battery assembly (5) is defined between the smoking end (3) and the oil reservoir (2), the oil reservoir (2) is detachably connected to the battery assembly (5);

the atomization assembly (4) is detachably connected to an inside of the oil reservoir (2);

the battery assembly (5) comprises:

a battery sleeve (51);

a battery (52) which is accommodated inside the battery sleeve (51);

a first thread sleeve (53) which is defined at an end of the battery sleeve (51) which is close to the oil reservoir (2) and is used for detachably connecting to the oil reservoir (2);

the atomization assembly (4) further comprises:

an atomization support (43);

an atomization electrode (44) which is fixedly defined inside the atomization support (43) and is electrically connected to a heating coil assembly (41);

an insulating ring (45) which is defined between the atomization support (43) and the atomization electrode (44);

an atomization sleeve (46) which is defined on the atomization support (43), an oil transferring device (42) is defined inside the atomization sleeve (46);

the oil reservoir (2) comprises:

a body portion (21);

a protrude portion (214) which is defined at an end surface of the body portion (21) which is close to the battery assembly (5) and is formed with a decreasing diameter of the body portion (21) along an axial direction of the body portion (21), a via hole which is used for inserting the oil transferring device (42) into the body portion (21) which is a hollow structure is defined in the protrude portion (214);

the atomization support (43) is fixedly abutted against the protrude portion (214), and a second thread sleeve (22) which is used for detachably connecting to the first thread sleeve (53) is defined at the atomization support (43);

a filling hole which is used for filling the tobacco tar is defined at an end surface of the body portion (21) which is close to the battery assembly (5), a hole plug (25) is detachably defined at the filling hole;

a second air inlet (511) is defined at a sidewall of the battery sleeve (51) which is close to the oil reservoir (2), a smoke passage (54) which is used for communicating the second air inlet (511) with the smoking end (3) is defined inside the battery assembly (5);

the smoking end (3) is defined outside an end of the battery assembly (5), or the smoking end (3) is placed in a middle part of the battery assembly (5), or the smoking end (3) is arranged at a position of the battery assembly (5) which is on an opposite side of the oil reservoir (2);

the atomization assembly (4) is coaxially defined with the battery assembly (5);

the oil reservoir (2) is a transparent container.

* * * * *